US009276337B2

(12) United States Patent
Dunn

(10) Patent No.: US 9,276,337 B2
(45) Date of Patent: Mar. 1, 2016

(54) DYNAMICALLY STABLE SURFACE MOUNT POST HEADER

(71) Applicant: Continental Automotive Systems, Inc., Auburn Hills, MI (US)

(72) Inventor: Thomas Gregory Dunn, Farmington Hills, MI (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 91 days.

(21) Appl. No.: 13/724,473

(22) Filed: Dec. 21, 2012

(65) Prior Publication Data

US 2014/0179130 A1 Jun. 26, 2014

(51) Int. Cl.

| | |
|---|---|
| ***H01R 12/00*** | (2006.01) |
| ***H01R 12/57*** | (2011.01) |
| ***H01R 12/71*** | (2011.01) |

(52) U.S. Cl.
CPC ..... *H01R 12/57* (2013.01); *H01R 12/718* (2013.01)

(58) Field of Classification Search
USPC ..... 439/83, 78–79
See application file for complete search history.

(56) References Cited

U.S. PATENT DOCUMENTS

| | | | | | |
|---|---|---|---|---|---|
| 4,647,126 | A | * | 3/1987 | Sobota, Jr. | 439/74 |
| 4,968,263 | A | * | 11/1990 | Silbernagel et al. | 439/246 |
| 4,969,829 | A | * | 11/1990 | Sato | 439/83 |
| 5,263,882 | A | * | 11/1993 | Peterson | 439/733.1 |
| 5,441,430 | A | * | 8/1995 | Seidler | 439/876 |
| 5,451,174 | A | * | 9/1995 | Bogursky et al. | 439/876 |
| 5,571,022 | A | * | 11/1996 | Schaarschmidt | 439/135 |
| 5,655,914 | A | * | 8/1997 | McCartin et al. | 439/78 |
| 5,931,705 | A | * | 8/1999 | Young | 439/682 |
| 5,957,739 | A | * | 9/1999 | Bianca et al. | 439/885 |
| 6,056,558 | A | * | 5/2000 | Lin et al. | 439/83 |
| 6,152,742 | A | * | 11/2000 | Cohen et al. | 439/60 |
| 2008/0000078 | A1 | * | 1/2008 | Borst | 29/739 |
| 2012/0193139 | A1 | | 8/2012 | Okuyama et al. | |

FOREIGN PATENT DOCUMENTS

| | | | |
|---|---|---|---|
| DE | 102006030135 | A1 | 1/2008 |
| EP | 0373003 | A2 | 6/1990 |
| EP | 0829924 | A2 | 3/1998 |

OTHER PUBLICATIONS

Samtec Company P/N TSM-102-02-T-SV-P-TR Two Pin Header—Datasheet.

International Search Report and Written Opinion dated Mar. 18, 2014, from corresponding International Patent Application No. PCT/US2013/076500.

* cited by examiner

*Primary Examiner* — Xuong Chung Trans

(57) ABSTRACT

A surface mount post header comprising at least one post and at least one lead, the post and the lead extending from a body and being distinct from each other, the body defining body's longitudinal axis, the lead configured to at least partially define a base of support for the post header on a surface of a substrate; the lead comprising a foot portion distal from the body, wherein at least one longitudinal portion of the foot portion forms an angle between 0 and 90 degrees with a projection of the body's longitudinal axis on the base of support is disclosed. In addition, a surface mount post header with a pick and place pad, and an assembly comprising the header and the substrate are disclosed.

13 Claims, 2 Drawing Sheets

DYNAMICALLY STABLE SURFACE MOUNT POST HEADER

BRIEF DESCRIPTION OF THE DRAWINGS

For a more complete understanding of the disclosure, reference should be made to the following detailed description and accompanying drawings wherein.

Figure 1:
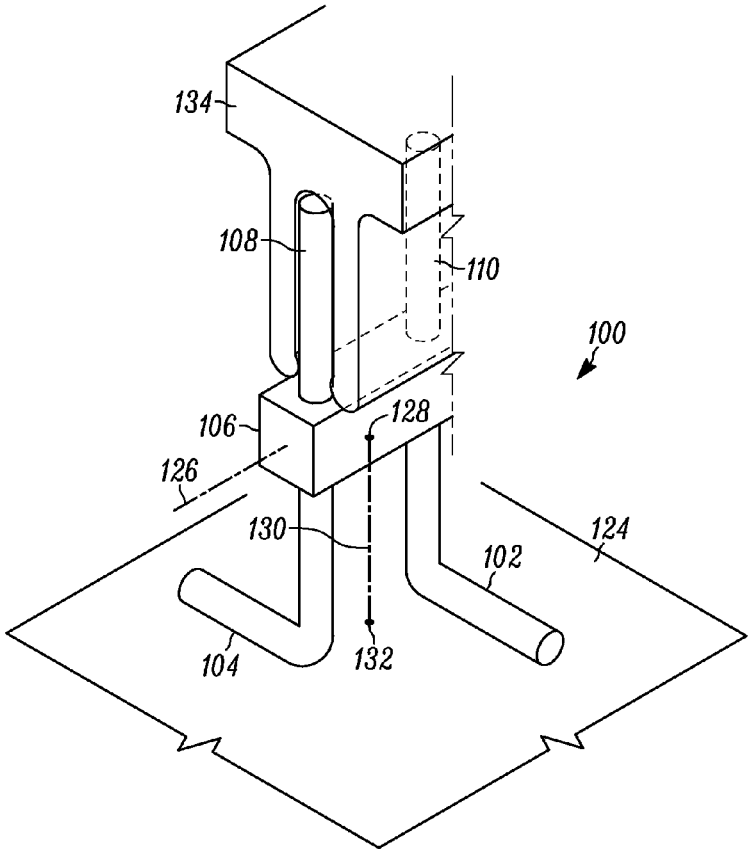
FIG. 1 comprises a perspective view of an exemplary post header.

Skilled artisans will appreciate that elements in the figures are illustrated for simplicity and clarity and have not necessarily been drawn to scale. For example, the size dimensions and/or relative positioning of some of the elements in the figures may be exaggerated relative to other elements to help to improve understanding of various aspects of the present invention. Also, common but well-understood elements that are useful or necessary in a commercially feasible embodiment are often not depicted in order to facilitate a less obstructed view of these various aspects of the present invention. Furthermore, it will be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

Automated pick and placement of surface mounted devices and components is a popular method for assembling electronic circuits. One type of surface mounted components are post headers, and in particular single row post headers. The post headers often comprise at least one electrically conductive post extending from one side of a body, typically an insulator body, and at least one lead extending from another side of the body, the post and the lead being electrically connected to each other. Moreover, the respective leads and the posts are often integrated with each other or comprise a unitary component, where one section, often an end section, serves as the post and another section, often a different end section, serves as the lead.

To stabilize single-row surface mount post headers after placement on a substrate, for example a circuit board, and thus reduce their likelihood of toppling during assembly, some of today's single-row surface mount post headers feature staggered leads, extending outwardly from the header and typically bent perpendicular to the posts' longitudinal axes. While such a solution may sometimes be adequate for headers with a larger number of leads, it is often insufficient to stabilize two-lead surface mount post headers, especially with an attached pick and place pad. Nonetheless, additional stabilization may also be desirable for headers with more or less than two leads and headers with more than a single row.

The general approach to further stabilizing an object is to maximize the work needed to move a ray described by the net force vector acting on the object beyond the edge of the base of support, the base of support being the area within an outline of segments connecting all points of contact between the object and the object's support, the support at least partially counteracting the force. In usual applications the net force vector is a net gravity force vector acting at the object's center of gravity. However other vectors, for example a net centripetal force vector acting at the object's center of mass, or otherwise, may also be considered. Moreover, each such vector will have its own respective base of support that may or may not correspond to any other vectors' bases of support. Therefore, it should be understood that the instant disclosure, although described in terms of the net gravity force vector in a uniform gravitational field acting at the object's center of gravity, also applies mutatis mutandi to other force vectors, including sums of vectors, acting on respective points associated with the object, and being associated with respective bases of support.

Accordingly, the stability of an object is related to the intersection of a ray described by the net gravitational force vector acting on the center of gravity, hereafter the gravity ray, and the base of support. One way of further stabilizing an object is increasing the distance between the intersection and an edge of the base of support, often the edge closest to the intersection, a method commonly referred to as widening of the base of support. However, depending on the application it may be desirable to reduce the distance from some edges, where the reduced stability is sufficient, and increase the distance from some other edges, where more stability is desirable. Another way of further stabilizing an object is increasing the object's mass, thus increasing the magnitude of the net gravitational force vector. Yet another is reallocating mass to move the center of gravity further in the direction of the net gravitational force vector, commonly referred to as lowering the center of gravity. Yet another is increasing the object's rotational inertia in the direction of typical toppling. Yet another is affixing an object to the base to add additional forces that at least partially counteract any toppling forces. For example, such affixing may take the form of placing a viscous material or otherwise between the object and the base or partially immersing the object in the viscous material, the viscous material also being in contact with the base. Other examples of affixing include soldering, welding, gluing, bolting, riveting, bonding, screwing, nailing or otherwise. A person skilled in the art will readily appreciate that the list of examples of affixing is non-exhaustive as a vast number methods of affixing an object to a base or another object are known. Moreover, a combination of any of these approaches may be used either alone or in combination with other approaches not described herein.

Thus, to further stabilize a surface mount post header, material may be added to the header or replaced with a denser material to increase the header's overall mass and rotational inertia. Since the leads often lie between the center of gravity of the object and the base of support at least partially, the additional mass is often distributed to the leads of the header to additionally move the center of gravity in the direction of the net gravitational force vector or to increase the header's rotational inertia. Moreover, the leads may be lengthened to increase the distance between the intersection and the edge of the base of support, often the edge closest to intersection or an edge in the direction of typical toppling of headers, or to increase the rotational inertia of the header. Furthermore, the leads can be formed or oriented so that the distance between the intersection and an edge of the base of support is increased or the rotational inertia of the header is increased. Also, a viscous material, such as for example solder paste or otherwise, may be placed adjacent to the leads to provide additional support or damping of disturbance forces.

With reference to FIG. 1, an exemplary header is a two-lead header 100. However, in other aspects the header comprises more than two leads, including, but not limited to, leads arranged in a single row or multiple rows. The exemplary header 100 comprises the leads 102 and 104, extending from a body 106, and two posts 108 and 110. The body 106 defines a longitudinal axis 126. The header is configured to be placed on a substrate 124 so that the at least one lead 102 or 104 is configured to at least partially define the base of support on the substrate 124. Moreover the header has an attached pick and place pad 134 configured to aid a pick and place mechanism in picking up and placing the header on the substrate 124. While in this example the center of gravity 128 of the header is located inside the body 106, in other examples the center of gravity may be located outside of the body, inside other elements of the header, or outside the header altogether. The gravity force ray 130 originates at the center of gravity 128, and, in this example, defines an intersection 132 with the base of support.

Figure 2:
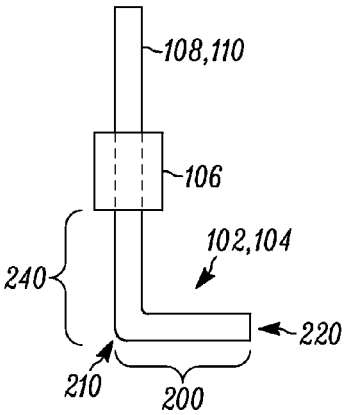
FIGS. 2-4 comprise side views of various post header lead configurations.
Figure 3:
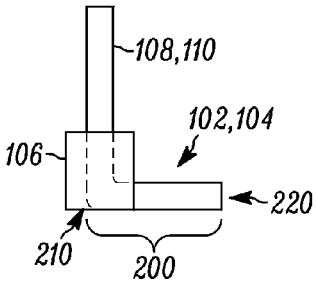
Figure 4:
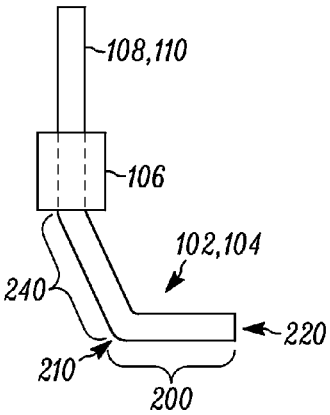

With reference to FIGS. 2, 3, and 4 and continued reference to FIG. 1, at least one of the leads 102 or 104 comprises a respective foot portion 200, the foot portion configured to come in contact with a surface of substrate 124, but not penetrate to the opposite surface of the substrate 124. At least one foot portion 200 longitudinally comprises a heel portion 210 and a toe portion 220.

With reference to FIGS. 2 and 4 and continued reference to FIG. 1, the heel portion 210 forms an angle, other than a straight angle, with a leg portion 240 of the lead 102 or 104 if the leg portion is present, the leg portion being most proximal to the respective post 108 or 110. Otherwise, with reference to FIG. 3, if the leg portion is not present, the heel portion 210 forms an angle, other than a straight angle, with respect to the respective post 108 or 110.

With continued references to FIGS. 2-4 and FIG. 1, in an example, at least one toe portion 220 is configured to come in contact with a surface of the substrate 124, but not penetrate to the opposite surface of the substrate. In an example, at least one heel portion 210 is configured to come in contact with a surface of the substrate 124, but not penetrate to the opposite surface of the substrate 124.

It should be understood that for the purposes of examples described herein, the exemplary geometric projections on the bases of support are constructed considering the direction of the initial steady state net gravitational force acting on the center of gravity of the object and the initial steady state base of support. However, the projections may also be constructed with respect to bases of support or net forces acting on the object in other states including states other than the initial steady state, and used to determine a configuration of adequate stability for the respective state.

For the purposes of conciseness in the following examples continued reference to FIGS. 1-4 is made in addition to the respective explicit references to FIGS. 5-13.

Figure 5:
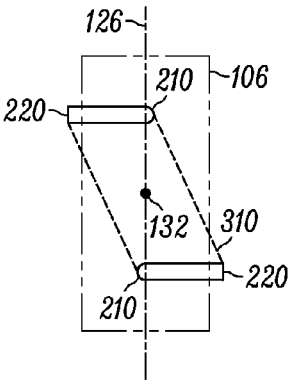
FIGS. 5-13 comprise bottom views of various post header lead configurations.
Figure 6:
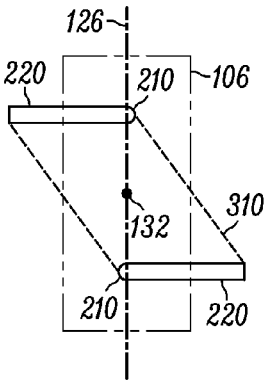

With reference to FIG. 5, in an example, at least one lead's 102 or 104 mass is greater such that stability is substantially increased. With reference to FIG. 6, at least one lead's 102 or 104 geometric projection on the base of support 310 is longer such that stability is substantially increased. With further reference to FIGS. 6, and 8-13, at least one lead 102 or 104 is longer such that stability is substantially increased.

Figure 7:
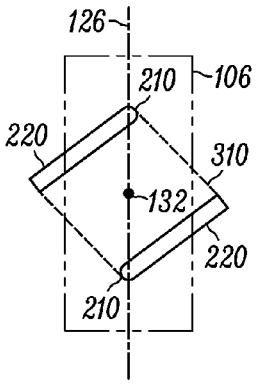
Figure 8:
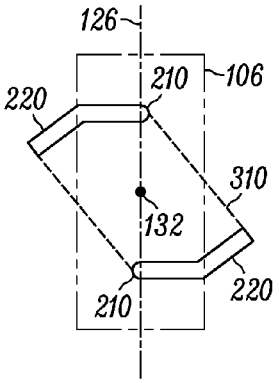
Figure 9:
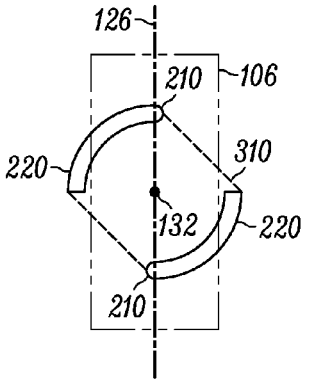
Figure 10:
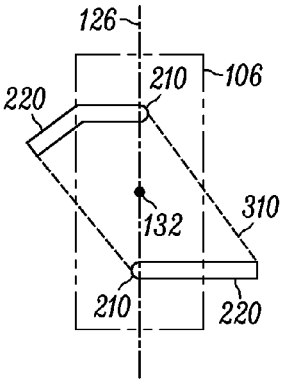
Figure 11:
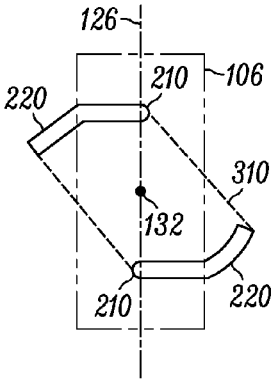
Figure 12:
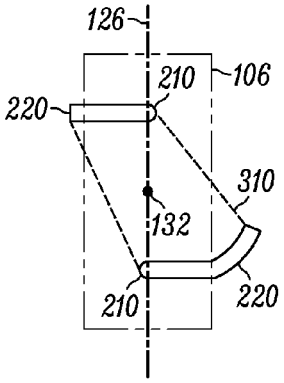
Figure 13:
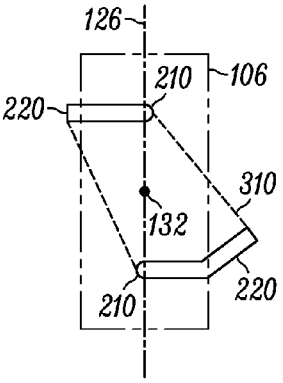

With reference to FIGS. 5 and 7-11, in an example, at least one lead 102 or 104 is formed FIGS. 8-11 or oriented FIG. 7 to reconfigure the base of support 310 such that stability is substantially increased. With further reference to FIGS. 7-13, in an aspect, at least one lead 102 or 104 is formed or oriented so that the respective toe portion 220 forms an angle between 0 and 90 degrees with the geometric projection of the longitudinal axis 126 of the body 106 on the base of support 310 such that stability is substantially increased. With further reference to FIGS. 6-13, in an aspect, at least one lead 102 or 104 is formed or oriented so that the respective toe portion 220 forms an angle substantially greater than 0 but substantially less than 90 degrees with the geometric projection of the longitudinal axis 126 of the body 106 on the base of support 310 such that stability is substantially increased. With further reference to FIGS. 7-13, in an aspect, at least one lead 102 or 104 is formed or oriented so that the respective toe portion 220 forms an angle of about 45 degrees with the geometric projection of the longitudinal axis 126 of the body 106 on the base of support 310 such that stability is substantially increased. With reference to FIGS. 9 and 11-13, in an example, at least one foot portion 112 or 114 at least partially follows a smooth curve such that stability is substantially increased. With reference to FIGS. 8, 10-11, and 13 in an example, at least one foot portion 112 or 114 is sharply bent such that stability is substantially increased.

In an aspect, at least one lead 102 or 104 is formed or oriented so that the distances from the edges of the base of support, the edges at least partially defined by the distal end of the respective toe portion 220, to the intersection are at least partially optimized. The distances are optimized when the stability of the header is substantially increased for a particular application. Accordingly, the distances are at least partially optimized when there is a noticeable improvement in stability. It will be understood that depending on the particular application more than one optimal or partially optimal configuration may be possible.

Those skilled in the art will recognize that a wide variety of modifications, alterations, and combinations can be made with respect to the above described embodiments without departing from the spirit and scope of the invention, and that such modifications, alterations, and combinations are to be viewed as being within the scope of the invention. Further, those skilled in the art will recognize that the approaches described herein may also be used to stabilize components and devices other than surface mounted post headers.

What is claimed is:

1. A surface mount post header comprising:

a body; and at least one post and at least one lead extending from the body and being distinct from each other;

the lead configured to at least partially define a base of support for the post header on a surface of a substrate;

the lead including a foot portion for contacting the surface of the substrate, the lead including a leg portion, the foot portion including a heel portion and a toe portion, the heel portion connecting the leg portion to the toe portion, the heel portion forming an angle with respect to the leg portion, the foot portion being configured to contact the substrate along the length of the foot portion from the heel portion to the toe portion, the foot portion comprising at least one bend or curve between the heel portion and the toe portion disposed along the base of support and configured to be disposed along the substrate.

2. The surface mount post header as recited in claim 1 wherein the foot portion at least partially follows a smooth curve along the base of support.

3. The surface mount post header as recited in claim 1 wherein the heel and toe portions are coupled to each other by a sharp bend.

4. The surface mount post header as recited in claim 1 further comprising a pick and place pad.

5. The surface mount post header as recited in claim 4 wherein the pick and place pad is attached to at least one of the at least one post.

6. An assembly comprising:

a substrate having a surface; and a surface mount post header including a body and at least one post and at least one lead extending from the body;

the at least one post and at least one lead being distinct from each other;

the lead configured to at least partially define a base of support for the post header on the surface of the substrate;

the lead including a foot portion contacting the surface of the substrate; and the foot portion including a heel portion and a toe portion, wherein the foot portion contacts the substrate along the length of the foot portion from the heel portion to the toe portion, the toe portion not being formed as a straight line with respect to the heel portion along the base of support and the substrate.

7. The assembly as recited in claim 6 wherein at least one of the at least one lead is affixed to the substrate.

8. The assembly as recited in claim 7 wherein the at least one of the at least one lead is affixed to the substrate by soldering.

9. The assembly as recited in claim 6 wherein the foot portion as least partially follows a smooth curve along the base of support.

10. An assembly comprising:

a substrate having a surface; and a surface mount post header including a body and at least one lead extending from the body;

the lead configured to at least partially define a base of support for the post header on the surface of the substrate;

the lead including a foot portion contacting the surface of the substrate, the lead including a leg portion, the foot portion including a heel portion and a toe portion, the heel portion connecting the leg portion to the toe portion, the heel portion forming an angle with respect to the leg portion, the foot portion contacting the substrate along the length of the foot portion from the heel portion to the toe portion, the foot portion comprising at least one bend or curve between the heel portion and the toe portion disposed along the base of support and disposed along the substrate.

11. The assembly of claim 10, wherein the foot portion at least partially follows a smooth curve along the substrate.

12. The assembly of claim 10, wherein the heel and toe portions are coupled to each other by a sharp bend.

13. The assembly of claim 10, further comprising a pick and place pad.

* * * * *